US005259608A

United States Patent [19]

Pollich

[11] Patent Number: 5,259,608

[45] Date of Patent: Nov. 9, 1993

[54] SHEET DELIVERY AT A PRINTING MACHINE

[75] Inventor: Gerhard Pollich, Heidelberg, Fed. Rep. of Germany

[73] Assignee: Heidelberger Druckmaschinen Aktiengesellschaft, Heidelberg, Fed. Rep. of Germany

[21] Appl. No.: 978,781

[22] Filed: Nov. 19, 1992

[30] Foreign Application Priority Data

Dec. 4, 1991 [DE] Fed. Rep. of Germany ... 9115032[U]

[51] Int. Cl.[5] ..... B65H 29/24

[52] U.S. Cl. ..... 271/183; 271/204; 271/207

[58] Field of Search ..... 271/183, 194, 195, 196, 271/197, 211, 207, 204

[56] References Cited

U.S. PATENT DOCUMENTS 2,645,480 7/1953 Long .
2,895,552 7/1959 Pomper ..... 271/197 X
4,372,550 2/1983 Woods ..... 271/211
4,643,414 2/1987 Weisgerber ..... 271/211 X
4,702,468 10/1987 Pollich ..... 271/211 X

FOREIGN PATENT DOCUMENTS 2944227 5/1980 Fed. Rep. of Germany .
4012940 10/1991 Fed. Rep. of Germany .
2037259 7/1980 United Kingdom .

*Primary Examiner*—Richard A. Schacher
*Attorney, Agent, or Firm*—Nils H. Ljungman & Associates

[57] ABSTRACT

Sheet delivery apparatus at a printing machine. The sheet delivery apparatus comprises a chain conveying system for conveying printed sheets to a delivery pile and a suction roller for decelerating the sheets before being deposited on the pile. A suction chamber, positioned below the chain-conveying system, extends over the width of the sheets and up to the suction roller. In the region of the upper sheet layers of the delivery pile, suction boxes are disposed at four lateral pile surfaces.

20 Claims, 3 Drawing Sheets

SHEET DELIVERY AT A PRINTING MACHINE

BACKGROUND OF THE INVENTION

1. Field of the Invention

The present invention generally relates to a sheet delivery apparatus at a printing machine. The sheet delivery apparatus comprises a chain-conveying system for conveying the printed sheets to a delivery pile via an ascending sheet-guiding device and a suction roller for decelerating the sheets, blowers disposed above the sheets to be deposited and stops for aligning the sheets deposited on the pile.

2. Background Information

As shown in Federal Republic of Germany Laid Open Patent Application No. 40 12 940 A1, due to the high speed of today's printing machines the conveying and depositing of printed sheets must generally meet high requirements in order to prevent the printed sheets from being damaged and to nevertheless achieve a substantially exact sheet piling. As disclosed in Federal Republic of Germany Laid Open Patent Application No. 29 44 227 A1 and U.S. Pat. No. 2,645,480, attempts have already been made to supply certain selective locations with blowing air and to evacuate air from other locations; however, this method proved successful only to some extent. These attempts essentially did not result in a solution aimed at improving the entire sheet-delivery system.

OBJECT OF THE INVENTION

Proceeding from the known arrangements discussed above, it is the object of the present invention to optimize the conveying and depositing of freshly printed sheets, to assist in the piling of the printed sheets on the delivery pile, and to remove harmful vapors from a sheet delivery apparatus.

SUMMARY OF THE INVENTION

According to the present invention, the above and other objects are achieved in that, below the chain-conveying system, a suction chamber extending over the sheet width is disposed, wherein this suction chamber also extends up to the suction roller. In other words, according to the present invention, the suction chamber is preferably configured to span such a width under the chain-conveying system that said width exceeds sheet width. Also, the suction chamber is also preferably configured to extend such a distance under the chain-conveying system that the chamber extends up to the suction roller. In the region of the upper sheet layers of the delivery pile, suction boxes are provided a the four lateral pile surfaces.

It will be appreciated that the solution according to the present invention ensures a smooth and uniform sheet transport via a chain-conveying system. Additionally, the blowers disposed above the delivery pile are supported in that the air escaping from underneath the sheet being deposited is immediately evacuated from all sides of the sheet so that the rate of vertical descent of a printed sheet is increased, thus avoiding a collision with a succeeding sheet. A further noteworthy advantage of the solution according to the present invention may be found in that the harmful vapors emanating from the freshly printed sheets can be evacuated, so that the vapors do not enter the printshop. In applications in which the drying of sheets is done by UV, or ultraviolet drying, for example, any ozone and ammonia produced as a result of the drying of dispersion varnishes can immediately be evacuated so that the air conditions in the printshop in which the printing machine is set up, according to the solution of the present invention, are improved considerably.

In an advantageous embodiment of the invention, at the delivery pile, the suction openings of the lateral and rear suction boxes, as seen in the direction in which sheets are conveyed, are directed towards the lateral surfaces of the sheet pile, while the front suction box is disposed above the level of the pile, wherein the suction openings of the suction box point generally downwards. Thus, the upper region of the delivery pile is essentially optimally supplied with air and the sheet to be deposited can be lowered faster.

Another advantage associated with the present invention is the fact that the suction air is continuously evacuated and can be controlled in the suction chamber or the suction boxes with respect to quantity and intensity, thus adjusting the quantity of energy required to the respective condition, or operational context. The adjustment of the lateral and rear suction boxes with respect to the paper format of the paper being printed upon can permit optimal evacuation. Such adjustment of the lateral and rear suction boxes may include positional adjustment.

In summary, one aspect of the invention resides broadly in a sheet delivery apparatus of a printing machine, the printing machine comprising at least one printing unit and a sheet delivery area, the sheet delivery area being configured for receiving sheets delivered thereto and piling the sheets atop one another, the sheet delivery area having an upper portion and, at the upper portion, four lateral side areas corresponding to four lateral sides of delivered sheets, the apparatus comprising: means for conveying sheets to the sheet delivery area, the conveying means extending between the printing unit and the sheet delivery area and being configured for transporting sheets from the at least one printing unit to the sheet delivery area; means for guiding the sheets during the transport of the sheets between the printing unit and the sheet delivery area; blower means disposed above the sheet delivery area for blowing air downwardly onto sheets being delivered; a plurality of suction means being mounted at the sheet delivery area for providing suction at the upper portion of the sheet delivery area; and the plurality of suction means comprising four suction means, each of the four suction means being configured for providing suction at a corresponding one of the four lateral side areas of the upper portion of the sheet delivery area.

BRIEF DESCRIPTION OF THE DRAWINGS

A specimen embodiment of the invention is schematically illustrated in the drawings, wherein.

DESCRIPTION OF THE PREFERRED EMBODIMENT

Figure 1:
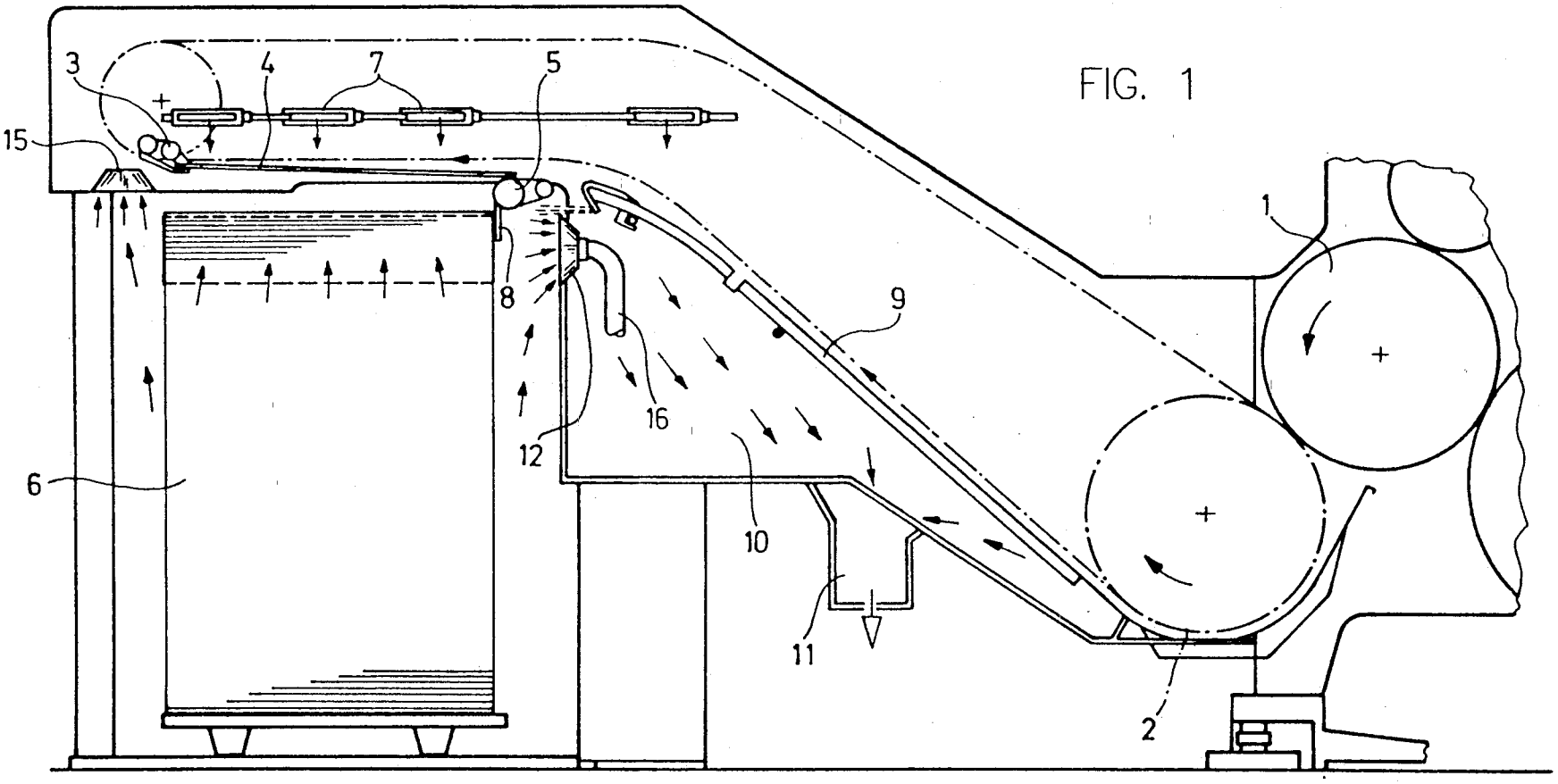
FIG. 1 is a side view of a sheet delivery apparatus comprising suction devices.

With the sheet delivery apparatus shown in FIG. 1, the sheets to be printed are preferably forwarded from the impression cylinder 1 to a chain-conveying system 2 on which a plurality of gripper bridges 3 are disposed to convey the printed sheets 4. In the position shown in FIG. 1, the printed sheet is decelerated at its trailing end by a suction roller 5 and then deposited on a delivery pile 6. In order to accelerate the deposition of sheets, blowers 7 can be provided above the sheet 4. Once on the delivery pile 6, the sheets deposited can preferably be aligned by means of stops 8 or other alignment devices known in the art.

Below the chain-conveying system 2, a sheet-guiding device 9 is preferably provided in the region in which, as shown, the sheets 4 ascend towards suction roller 5. A suction chamber 10, preferably connected to a suction device via a connection 11, can preferably be disposed below the sheet-guiding device 9. Essentially, the suction chamber 10 improves the guiding of sheets and permits the immediate evacuation of harmful vapors resulting from the use of drying devices, for example. It should be appreciated that, essentially, suction chamber 10 improves the guiding of sheets 4 by providing a suction in such a way that sheets 4, while ascending along conveyor 2 towards suction roller 5, are essentially encouraged downwardly, towards sheet-guiding device 9. Sheet-guiding device 9 may be provided with a plurality of orifices therein, to allow direct suction onto the underside of sheets 4.

Figure 2:
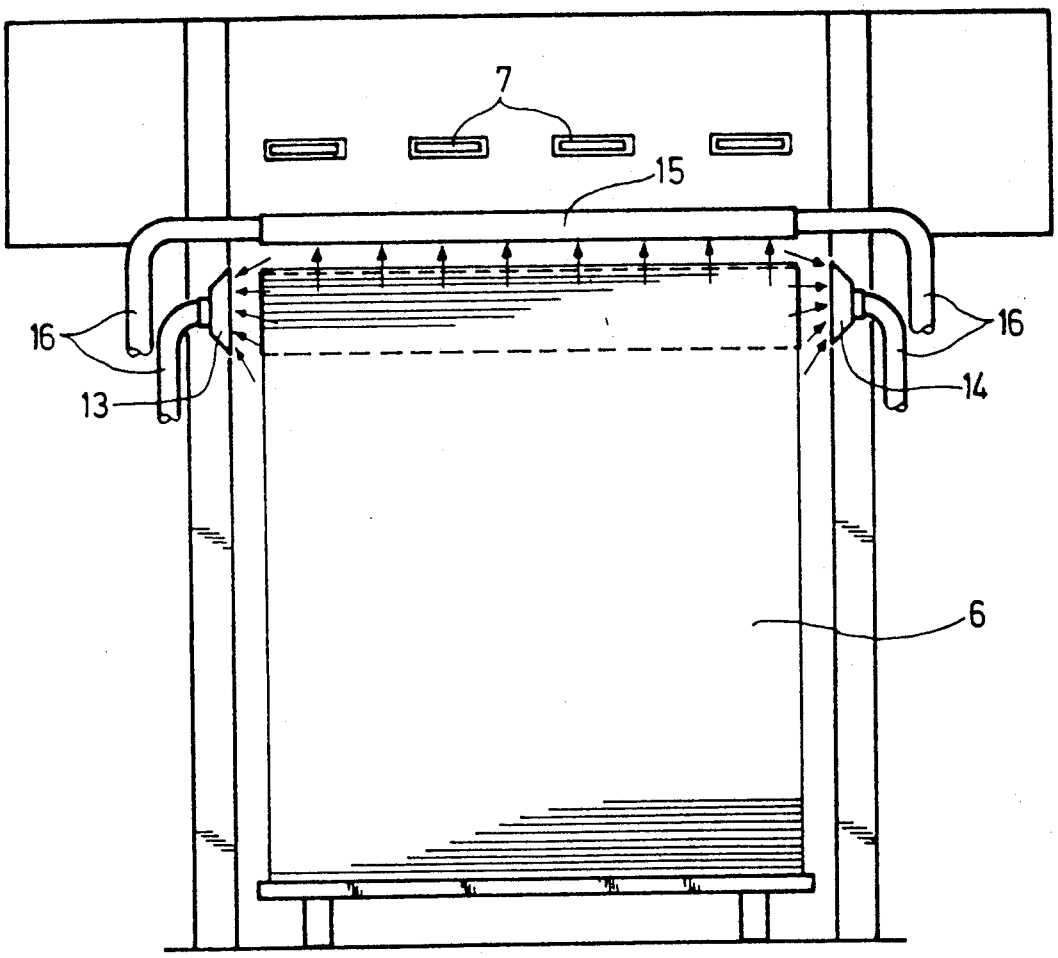
FIG. 2 is a front-end view of the sheet delivery apparatus comprising lateral suction boxes.

As shown in the two views afforded by FIGS. 1 and 2, in the region of the upper sheet layers of the delivery pile 6, suction boxes 12, 13, 14, 15 are preferably provided at the four lateral pile surfaces. All of the suction boxes 12–15 are preferably connected to suction devices via connecting pipes 16. The openings of the suction boxes 12, 13, and 14 are preferably oriented in a direction of the lateral surfaces of delivery pile 6 and the opening of the suction box 15 is preferably oriented downwardly, wherein suction box 15 is preferably provided somewhat above an upper level of delivery pile 6. In other words, in accordance with the present invention, three suction boxes 12, 13 and 14 are each preferably provided, respectively, at a rear lateral portion of delivery pile 6 and at two side lateral portions of delivery pile 6. Each of the suction boxes 12, 13, 14 are preferably configured for providing suction in a lateral direction at each of their corresponding lateral portions of the upper portion of delivery pile 6. On the other hand, however, suction box 15, while being positioned at the front lateral portion of delivery pile 6, is preferably configured for providing suction in an upward direction at that front lateral portion and, therefore, is preferably positioned such that it is oriented generally downwardly. It will be appreciated that "front" and "rear" are taken here to mean, respectively, that portion of delivery pile 6 where the leading edge portions of sheets 4 are aligned and that portion of delivery pile 6 where the trailing edge portions of sheets 4 are aligned. Accordingly, "side" can be taken here to mean those portions of delivery pile 6 aligned generally transversely with respect to the leading edge portions and trailing edge portions of sheets 4.

As will be appreciated from FIG. 2, the arrangement of suction boxes 12–15 described immediately above essentially makes it possible to immediately evacuate the air laterally escaping when depositing the sheets, wherein blowers 7 blow air downwardly on the upper surface of sheets 4 and enhance the lowering motion of the sheets by essentially pushing the sheets 4 in a downward direction onto the delivery pile.

Figure 3:
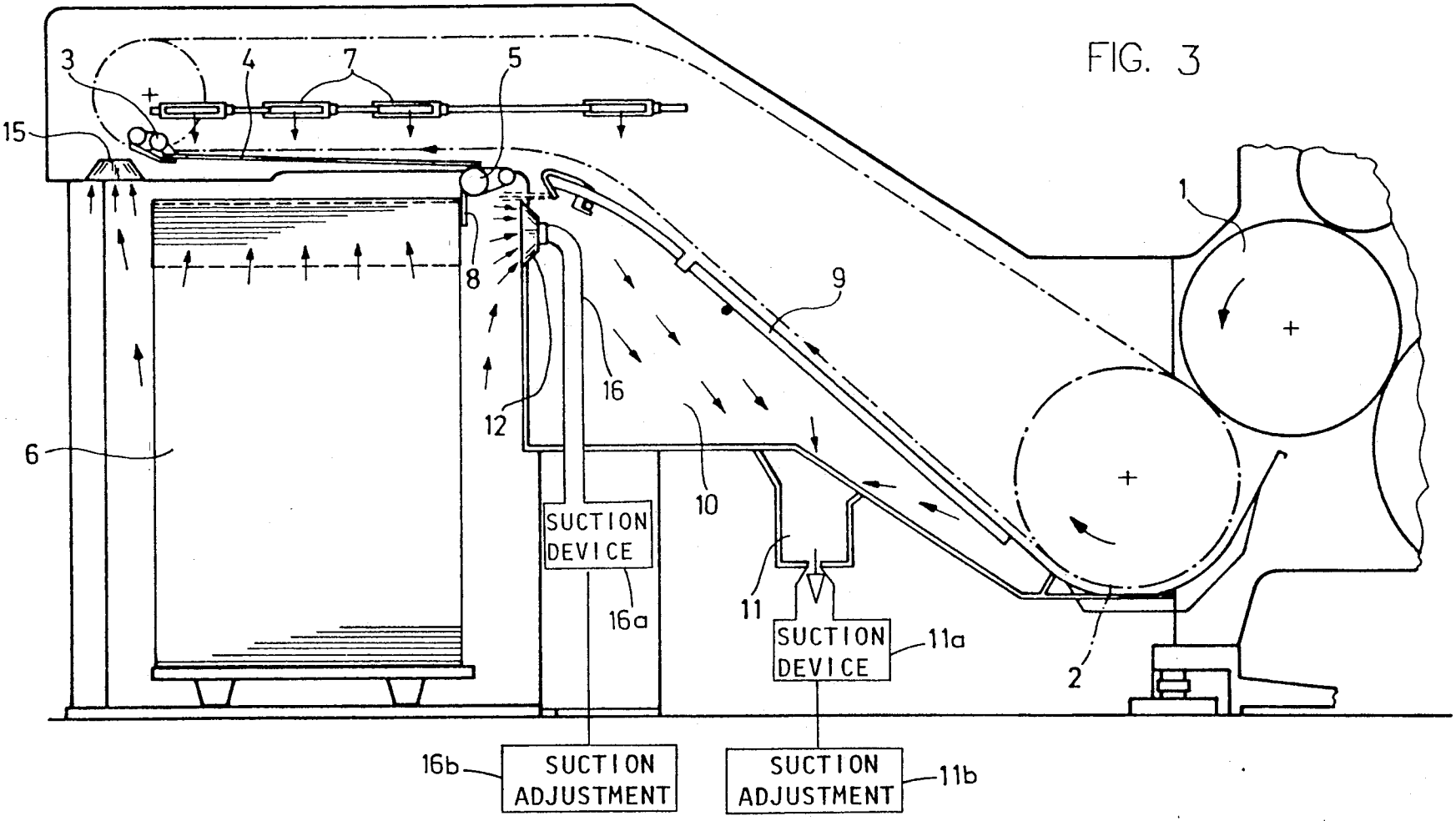
FIG. 3 is essentially the same view as FIG. 1*a*, but additionally depicting the suction devices themselves.

FIG. 3 is essentially similar to FIG. 1, but additionally depicts suction devices for providing suction in suction chamber 10 and in suction boxes 12–15. As shown, one suction device **11*a* can preferably provide suction for chamber 10 through connection 11, and another suction device 16*a* can preferably provide suction for suction boxes 12–15 through connections 16**.

The suction devices **11*a* and 16*a* preferably remove the suction air from continuously from the individual stations concerned. In addition, the suction devices 11*a* and 16*a* are preferably provided with means for controlling the quantity and intensity of the suction air, thus making it possible to prevent harmful vapors, given off by inks or produced during drying, from entering the printshop. Such means for controlling the quantity and intensity of suction air are indicated at 11*b* and 16*b* in FIG. 3, wherein suction adjustment device 11*b* is provided for suction device 11*a* and suction adjustment device 16*b* is provided for suction device 16*a*. It should be understood that it is possible to employ several different types of suction arrangements for either suction chamber 10 or suction boxes 12–15. In the case of suction boxes 12–15, it may be possible to provide separate suction devices 16*a*, along with separate suction adjustment devices 16*b* for each of the suction boxes 12–15. Alternatively, it may be possible to provide a single suction device 16*a* for suction boxes 12–15. In either case, one suction adjustment device or several suction adjustment devices 16*b* may be configured to either provide uniform, simultaneous adjustment to all of the suction boxes 12–15, or separate, individual adjustment of each of the suction boxes 12–15**, or both.

One aspect of the invention resides broadly in a sheet delivery at a printing machine comprising a chain-conveying system for conveying the printed sheets to a delivery pile via an ascending sheet-guiding device, and a suction roller for decelerating the sheet, blowers disposed above the sheets to be deposited, and stops for aligning the sheets deposited on the sheet pile, characterized in that a suction chamber (10) extending over the sheet width up to a suction roller (5) is provided below a chain-conveying system (2), and that in the region of the upper sheet layers of the delivery pile (6) suction boxes (12–15) are disposed at the four lateral pile surfaces.

Another aspect of the invention resides broadly in a sheet delivery characterized in that at the delivery pile (6) the suction openings of the lateral and rear suction boxes (12–14), seen in sheet-conveying direction, are directed towards the lateral pile surfaces, and that, seen in sheet-conveying direction, the front suction box (15) is disposed somewhat above pile level, the suction opening of said suction box pointing downwards.

Yet another aspect of the invention resides broadly in a sheet delivery, characterized in that the suction air is continuously removed and can be controlled within the suction chamber (10) and the suction boxes (12–15), respectively, as to quantity and intensity.

A further aspect of the invention resides broadly in a sheet delivery characterized in that the lateral and rear suction boxes (12–14) are mounted so as to be adjustable to the paper format to be printed.

Examples of sheet stop arrangements, at a sheet delivery area of a printing machine, as well as other components associated with sheet delivery, may be found in the following U.S. Pat. No. 5,054,765, which issued to Henn et al. on Oct. 8, 1991; and U.S. Pat. No. 5,102,117, which issued to Henn et al. on Apr. 7, 1992.

Examples of suction rollers, vacuum arrangements, and means for adjusting suction, which may be utilized in accordance with the embodiments of the present invention, may be found in the following U.S. Pat. No. 5,110,112, which issued to Henn et al. on May 5, 1992; U.S. Pat. No. 5,109,741, which issued to Fuchs on May 5, 1992; U.S. Pat. No. 4,728,092, which issued to Selak on Mar. 1, 1998; and U.S. Pat. No. 2,645,480, which issued to Long on Jul. 14, 1953.

All, or substantially all, of the components and methods of the various embodiments may be used in any combination with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

LIST OF REFERENCE NUMERALS

1 impression cylinder
2 chain-conveying system
3 gripper bridge
4 sheet
5 suction roller
6 delivery pile
7 blower
8 stop
9 sheet-guiding device
10 suction chamber
11 connection
11*a* suction device
11*b* suction adjustment
12 suction box
13 suction box
14 suction box
15 suction box
16 connecting pipe
16*a* suction device
16*b* suction adjustment

What is claimed is:

1. Sheet delivery apparatus of a printing machine, the printing machine comprising at least one printing unit and a sheet delivery area, the sheet delivery area being configured for receiving sheets delivered thereto and piling the sheets atop one another, the sheet delivery area having an upper portion and, at the upper portion, four lateral side areas corresponding to four lateral sides of delivered sheets, said apparatus comprising:

means for conveying sheets to the sheet delivery area, said conveying means extending between the printing unit and the sheet delivery area and being configured for transporting sheets from the at least one printing unit to the sheet delivery area;

means for guiding the sheets during the transport of the sheets between the printing unit and the sheet delivery area;

blower means disposed above the sheet delivery area for blowing air downwardly onto sheets being delivered;

a plurality of suction means being mounted at the sheet delivery area for providing suction at the upper portion of the sheet delivery area; and said plurality of suction means comprising four suction means, each of said four suction means being configured for providing suction at a corresponding one of the four lateral side areas of the upper portion of the sheet delivery area.

2. The apparatus according to claim 1, further comprising:

additional suction means being disposed between the printing unit and the sheet delivery pile; and said additional suction means being configured for providing suction on the delivered sheets, during the transport of the sheets between the printing unit and the sheet delivery pile, to bias the delivered sheets onto said guiding means.

3. The apparatus according to claim 2, further comprising means for decelerating each sheet as each sheet is delivered from said sheet conveying means to the sheet delivery area.

4. The apparatus according to claim 3, wherein each of the sheets has a leading edge portion, defined forwardly in a direction of travel of the sheets, and a trailing edge portion opposite the leading edge portion, wherein:

said decelerating means comprises a suction roller;

said suction roller is configured for providing suction at the trailing end portion of each sheet to decelerate each sheet as each sheet is delivered form said sheet conveying means to the sheet delivery area.

5. The apparatus according to claim 4, wherein:

said additional suction means comprise a suction chamber;

said suction chamber is configured to extend between the printing unit and said suction roller.

6. The apparatus according to claim 5, wherein each sheet defines a sheet width transversely to the direction of travel of the sheets, said apparatus further comprising:

said suction chamber being configured to extend transversely across said sheet guiding means, over the entire sheet width of the sheets

7. The apparatus according to claim 6, wherein said four suction means are configured for providing suction to evacuate air from between a delivered sheet and an adjacent delivered sheet on the pile of delivered sheets.

8. The apparatus according to claim 7, wherein the delivered sheets define a generally horizontal lay upon being piled in the pile of delivered sheets, said apparatus further comprising:

solely a first, a second, and a third of said four suction means being configured for providing suction in a direction generally parallel to the lay of the delivered sheets.

9. The apparatus according to claim 8, wherein a fourth one of said four suction means, other than said first, second and third suction means, is configured for providing suction in a direction different from the lay of the delivered sheets.

10. The apparatus according to claim 9, wherein said fourth suction means is configured for providing suction in a direction generally perpendicularly to the lay of the delivered sheets.

11. The apparatus according to claim 10, wherein the sheet delivery area is configured for aligning leading edge portions of the delivered sheets at a front lateral portion of the sheet delivery area and for aligning trailing edge portions of the delivered sheets at a rear lateral portion of the sheet delivery area, the sheet delivery area further defining side lateral portions thereof transversely to the front lateral portions and the rear lateral portions, said apparatus further comprising:

said fourth suction means being configured for providing suction generally upwardly with respect to the lay of the delivered sheets;

said fourth suction means being positioned generally above an area corresponding to the front lateral portion of the sheet delivery area;

said first suction means being positioned at the rear lateral portion of the sheet delivery area;

said second suction means and said third suction means being positioned at the side lateral portions of the sheet delivery area;

said conveying means comprising chain conveying means;

said blower means comprising four rows of blower outlets;

each of said rows of blower outlets comprising four blowers and extending in a direction generally transverse to the direction of travel of said sheets;

three of said rows of blower outlets being disposed above the sheet delivery area;

another of said rows of blower outlets being disposed above an upper portion of said conveying means and, with respect to the direction of travel of the sheets, before the suction roller;

said four suction means comprising:

means for providing suction to said four suction means;

conduit means extending from said four suction means to said suction providing means;

each of said four suction means comprising a singular suction box;

each said suction box being connected with said conduit means;

each said suction box extending generally completely across a corresponding lateral portion of the sheet delivery area;

each said suction box having a singular opening;

each said suction box being configured for providing suction through said singular opening;

said singular opening extending generally completely across a corresponding lateral portion of the sheet delivery area;

said singular opening being generally rectilinear; said additional suction means comprising:

additional suction providing means, said additional suction providing means for providing suction to said additional suction means;

additional conduit means being connected between said additional suction providing means and said suction chamber a front wall portion and an underside wall portion;

said front wall portion extending in a direction transverse to the direction of travel of the sheets;

one of said four suction means being disposed in said front wall portion;

said underside wall portion extending from the printing machine to the front wall portion;

a first section of said underside wall portion extending from the printing machine to said additional conduit means;

a second section of said underside wall portion extending from said additional conduit means to said front wall portion;

said first section of said underside wall portion being generally sloped; and said second section of said underside wall portion being generally horizontal.

12. The apparatus according to claim 1, wherein said four suction means are configured for providing suction to evacuate air from between a delivered sheet and an adjacent delivered sheet on the pile of delivered sheets.

13. The apparatus according to claim 12, wherein the delivered sheets define a generally horizontal lay upon being piled in the pile of delivered sheets, said apparatus further comprising:

solely a first, a second, and a third of said four suction means being configured for providing suction in a direction generally parallel to the lay of the delivered sheets.

14. The apparatus according to claim 13, wherein a fourth one of said four suction means, other than said first, second and third suction means, is configured for providing suction in a direction different from the lay of the delivered sheets.

15. The apparatus according to claim 14, wherein said fourth suction means is configured for providing suction in a direction generally perpendicularly to the lay of the delivered sheets.

16. The apparatus according to claim 15, wherein said fourth suction means is configured for providing suction generally upwardly with respect to the lay of the delivered sheets.

17. The apparatus according to claim 16, wherein the sheet delivery area is configured for aligning leading edge portions of the delivered sheets at a front lateral portion of the sheet delivery area, said apparatus further comprising:

said fourth suction means being positioned generally above an area corresponding to the front lateral portion of the sheet delivery area.

18. The apparatus according to claim 17, further comprising means for decelerating each sheet as each sheet is delivered from said sheet conveying means to the sheet delivery area.

19. The apparatus according to claim 18, wherein each of the sheets has a leading edge portion, defined forwardly in a direction of travel of the sheets, and a trailing edge portion opposite the leading edge portion, wherein:

said decelerating means comprises a suction roller;

said suction roller is configured for providing suction at the trailing end portion of each sheet to decelerate each sheet as each sheet is delivered from said sheet conveying means to the sheet delivery area.

20. The apparatus according to claim 19, wherein the sheet delivery area is configured for aligning trailing edge portions of the delivered sheets at a rear lateral portion of the sheet delivery area, the sheet delivery area further defining side lateral portions thereof transversely to the front lateral portions and the rear lateral portions, said apparatus further comprising:

said conveying means comprising chain conveying means;

said first suction means being positioned at the rear lateral portion of the sheet delivery area;

said second suction means and said third suction means being positioned at the side lateral portions of the sheet delivery area;

said blower means comprising four rows of blower outlets;

each of said rows of blower outlets comprising four blowers and extending in a direction generally transverse to the direction of travel of said sheets;

three of said rows of blower outlets being disposed above the sheet delivery area;

another of said rows of blower outlets being disposed above an upper portion of said conveying means and, with respect to the direction of travel of the sheets, before the suction roller;

said four suction means comprising:

means for providing suction to said four suction means;

conduit means extending from said four suction means to said suction providing means;

each of said four suction means comprising a singular suction box;

each said suction box being connected with said conduit means;

each said suction box extending generally completely across a corresponding lateral portion of the sheet delivery area;

each said suction box having a singular opening;

each said suction box being configured for providing suction through said singular opening;

said singular opening extending generally completely across a corresponding lateral portion of the sheet delivery area;

said singular opening being generally rectilinear;

said additional suction means comprising:

additional suction providing means, said additional suction providing means for providing suction to said additional suction means;

additional conduit means being connected between said additional suction providing means and said suction chamber;

a front wall portion and an underside wall portion;

said front wall portion extending in a direction transverse to the direction of travel of the sheets;

one of said four suction means being disposed in said front wall portion;

said underside wall portion extending from the printing machine to the front wall portion;

a first section of said underside wall portion extending from the printing machine to said additional conduit means;

a second section of said underside wall portion extending from said additional conduit means to said front wall portion;

said first section of said underside wall portion being generally sloped; and said second section of said underside wall portion being generally horizontal.

* * * * *